United States Patent [19]

Aspinwall

[11] 3,981,623

[45] Sept. 21, 1976

[54] TURBOMACHINE ROTOR STAGE

[75] Inventor: Robert H. Aspinwall, Zionsville, Ind.

[73] Assignee: General Motors Corporation, Detroit, Mich.

[22] Filed: May 2, 1975

[21] Appl. No.: 573,966

[52] U.S. Cl. ..... 416/215; 416/244 A

[51] Int. Cl.[2] ..... F01D 5/30

[58] Field of Search ..... 416/216–218, 416/215, 244 A

[56] References Cited

UNITED STATES PATENTS

| | | | |
|---|---|---|---|
| 883,890 | 4/1908 | Kieser | 416/215 |
| 1,371,327 | 3/1921 | Schneider | 416/215 |
| 1,545,495 | 7/1925 | Holzwarth | 416/216 |

FOREIGN PATENTS OR APPLICATIONS

| | | | |
|---|---|---|---|
| 502,349 | 5/1920 | France | 416/215 |
| 873,700 | 7/1942 | France | 416/215 |
| 1,192,330 | 10/1959 | France | 416/215 |
| 258,849 | 4/1913 | Germany | 416/215 |
| 560,951 | 10/1932 | Germany | 416/215 |
| 932,042 | 8/1955 | Germany | 416/215 |

*Primary Examiner*—Everette A. Powell, Jr.
*Attorney, Agent, or Firm*—Paul Fitzpatrick

[57] ABSTRACT

A compressor or turbine rotor stage includes a wheel with a circumferential slot for retention of the roots of blades mounted on the wheel. Each side of the rim of the wheel is approximately symmetrical about a line parallel to the axis of rotation of the wheel through the centroid of the section of the rim side and is of such asymmetrical configuration about a line normal to the axis of rotation that the shear center of each side of the rim is inboard of the centroid and preferably close to or inboard of the plane of action of the radial component of the forces exerted by the blade roots on the sides of the rim due to the centrifugal force pull of the blades.

2 Claims, 5 Drawing Figures

TURBOMACHINE ROTOR STAGE

My invention is directed to rotor stages of turbomachines such as axial-flow compressors and turbines. In particular, the invention lies in a configuration of the rim of a wheel on which blades are mounted. The configuration is such as to increase the resistance of the wheel rim to spreading of the rim due to the radial forces exerted on the rim by blades mounted in a circumferential slot in the rim. This is achieved by configuring the wheel rim so that it is symmetrical or nearly so with respect to an axis parallel to the axis of rotation of the wheel, but each side of the rim is asymmetrical with respect to an axis normal to the plane of rotation through the centroid of the section of the side. By proper proportioning of the rim, the shear center (also called flexural center) of each side of the rim is made to lie well inboard of the centroid of the side so that the radial component of force exerted by the blades on the rim has less tendency to open or spread the rim, and may tend to close the sides of the rim together rather than open them.

The principal objects of my invention are to improve the structure and utility of rotor stages, to provide a turbomachine wheel having maximum resistance to opening of a circumferential blade slot with respect to the mass of the rim, and to provide a turbomachine wheel having a rim in which the shear center of each side of the rim lies inboard of the centroid of the side of the rim. A more specific object is to have the shear center of each side of the rim approximate the axial location of the plane of application of the radial component of centrifugal forces of the blades on the side of the rim, or lie inboard of such plane.

The nature of the invention and its advantages will be clear to those skilled in the art from the succeeding detailed description of the preferred embodiment of the invention and the accompanying drawings.

Figure 1:
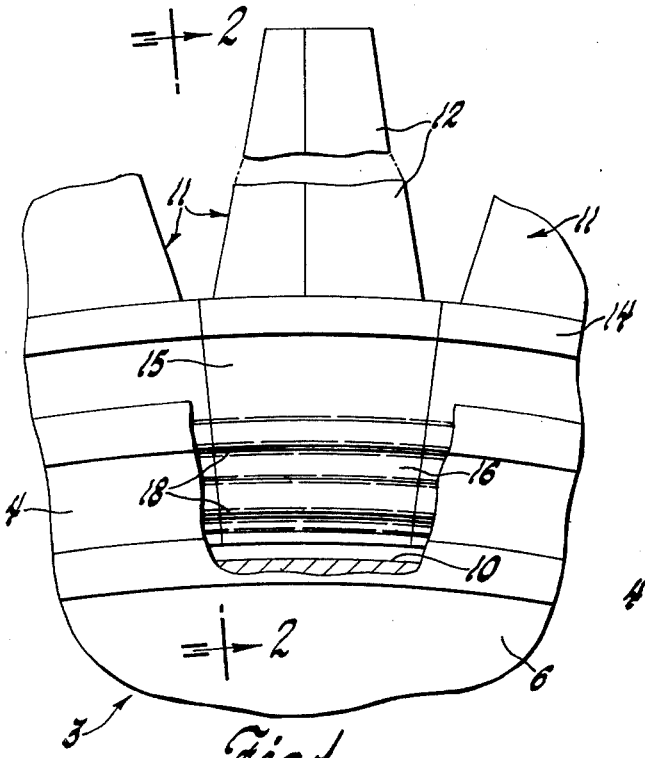
FIG. 1 is a fragmentary view of the rim portion of a turbomachine rotor stage taken in a plane perpendicular to the axis of rotation.
Figure 2:
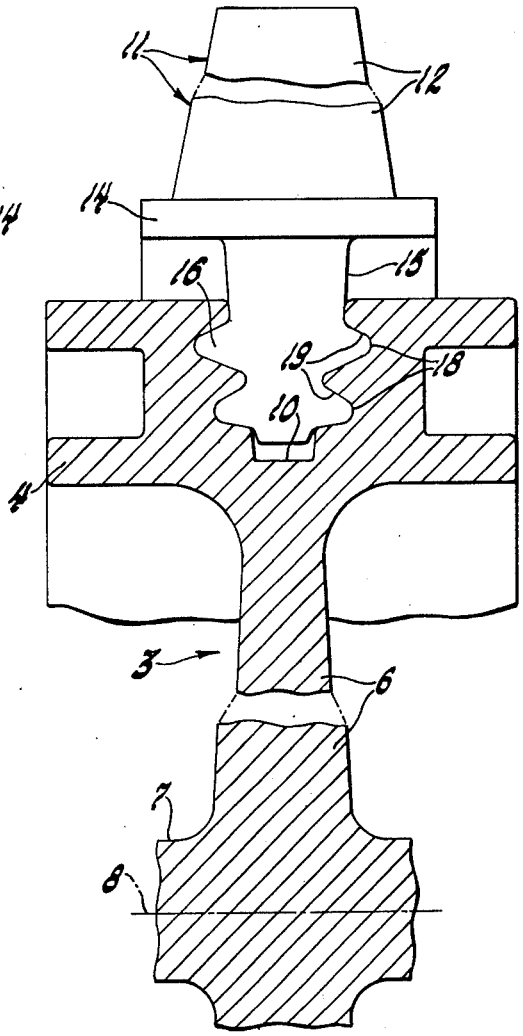
FIG. 2 is a cross-sectional view taken in a plane containing the axis of revolution as indicated by the line 2—2 in FIG. 1.

Referring first to FIGS. 1 and 2, the turbomachine rotor stage there illustrated may be a rotor stage of an axial-flow compressor or of an axial-flow turbine. The stage includes a wheel 3 having a rim 4 connected by an annular web or disk 6 to a hub or shaft 7. The wheel is radially symmetrical about an axis of rotation 8. The rim 4 defines a central circumferentially extending blade mounting slot 10 which receives an annular cascade of blades or blade elements 11. Each blade 11 as illustrated comprises an airfoil portion 12, a platform 14, a stalk 15, and a root 16. The particular configuration of blade illustrated is illustrative, since the details of blade structure are immaterial; for example, the platform is not essential to the invention nor is the presence of blade stalks spacing the airfoil portion from the wheel rim. As illustrated in FIG. 1, the roots, stalks, and platforms of adjacent blades are in abutment along a radial plane extending from the axis of rotation. The structure, as shown in FIG. 2, embodies a multiple dovetail form of blade attachment in which each blade root 16 bears two (or more) circumferentially extending ridges 18 each of which is lodged in a circumferentially extending groove 19 in the wall of slot 10. A stage such as that described here will have provision at some point in the slot 10 for entry of the blades and for securement of the last blade to be entered. My invention does not concern itself with such details, which can follow known practice in the art.

The point of my invention lies in the configuration of the wheel rim 4. In this connection, it will be appreciated that when the turbomachine is in service the wheel 3 ordinarily will rotate at high speed; thus, there are large centrifugal forces exerted by the individual elements of mass of the wheel and also by the blades. Specifically, the blades exert primarily a radial force due to centrifugal force which is exerted against the rim by the blade roots, and specifically in the form illustrated in FIGS. 2 and 3 by the ridges 18 on the blade roots bearing against the outer wall of the grooves 19 in the rim. There may be other forces owing to gas loading on the blades, but these need not be gone into here.

Figure 3:
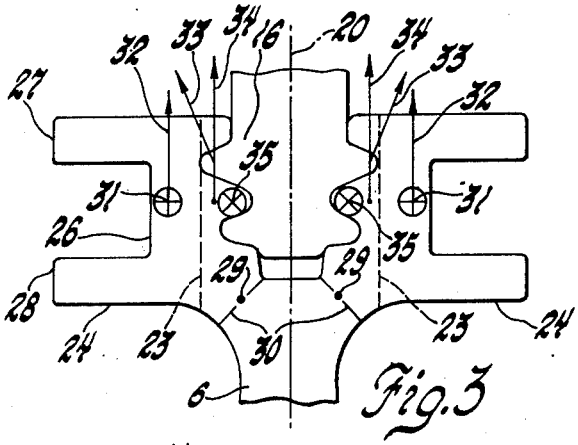
FIG. 3 is a diagram of forces on the wheel rim for explaining the invention.

Referring to the diagram of FIG. 3, the wheel 3 and rim 4 are bilaterally symmetrical with respect to a radial plane indicated by the broken line 20. This symmetrical relation need not be exact, but at least the two sides of the rim should be approximately mirror images of each other in cross section as illustrated in FIGS. 2 and 3.

For purposes of analysis we may consider the rim as including a central portion between the planes indicated by the lines 23, the planes being perpendicular to the axis of rotation and enclosing the portion of the rim in which the blade slot 10 is provided. Outboard of the central portion are lateral portions 24 of channel cross section including a web 26, an outer flange 27, and an inner flange 28. We may also consider the rim as divided into two portions, one on each side of the central plane indicated by line 20 and each connected to the web 6 of the wheel at the circumferential sections indicated by the lines 30 in the sketch. Each side of the rim may flex outwardly or inwardly as a beam supported from the wheel web 6, the flexure being approximately a rotation about a point 29 at the zone of juncture of the rim with the wheel web. It will be noted that each side of the rim outboard of the lines 30 may be considered as a channel section which is approximately symmetrical with respect to a line parallel to the axis of rotation. Each of these sections has a centroid 31 which is the center of moments of the section and is the point through which the centrifugal force acting on the section due to the mass of the rim side may be considered to act as indicated by the arrow or vector 32 which, of course, extends radially outward from the axis of rotation. This centrifugal force tends to move the rim sides toward each other, since it acts outboard of point 29.

The section of each side of the flange rim is highly unsymmetrical with respect to the plane extending radially through the centroid to secure the advantages of the invention, as will be pointed out.

Now considering further the action of centrifugal forces during operation of the rotor, it is apparent that the blades 11 will exert an outward force on the flanges of the rim at some point within the overlap of the ridges 18 and grooves 19. This force is indicated by the vectors 33 in FIG. 3. The action line of the radial component of this force is indicated by the arrows 34. The force indicated by 33 will be exerted at some point and at a particular angle depending upon the exact configuration of the ridges and grooves and the distribution of force between them. The component of this force parallel to the axis of rotation tends to open or spread the rim.

Since the radial component of blade centrifugal force in the illustrative embodiment is, as usual, outboard of the flexure point 29 it tends to pull the rim inward by the force couple of this force and the inward pull of the wheel on the rim. This effect ordinarily is less than the spreading couple due to the axial component of blade force on the rim.

However, it might appear that the radial component of blade force, well inboard of the centroid 31, would tend to roll the rim outwardly. Of course, any attempt to rotate the rim side either inwardly or outwardly will encounter a force resisting such rolling of the ring if the rim is continuous, or to some extent if it is in relatively long segments. This will be an elastic torque exerted in response to rotation of the rim side either outward or inward, the direction of force being such as to oppose such rotation.

This brings us to an interesting characteristic of rim sides of certain configurations; that is, generally symmetrical about an axis parallel to the axis of rotation such as an axis joining the two points 31 on FIG. 3, but asymmetrical about an axis normal to this axis through the centroid of the side, such as the axis along which the vector 32 lies.

This concerns the matter.of the shear center of flexural center of the section of one side of the rim 4. The considerations involved here are known and explained in text books on strength of materials, behavior of elastic bodies, and so forth. For those wishing to pursue the subject mention may be made of the following: "Strength of Materials" by Ferdinand L. Singer, Harper & Brothers, New York, 1951, pages 391–395; "Formulas for Stress and Strain" by Raymond J. Roark, Third Edition, McGraw-Hill Book Company, New York, 1954, pages 128–131; and "Theory of Elasticity", Third Edition, by Timoshenko and Goodier, McGraw-Hill Book Company, pages 371–374.

Figure 4:
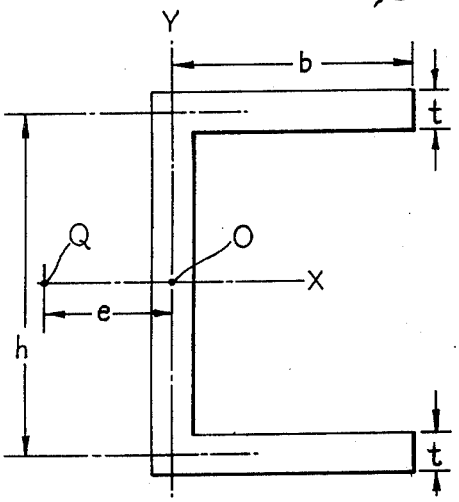
FIG. 4 is a further diagram illustrating the principles of the invention.

To summarize the matter briefly, if a beam is loaded in plane of symmetry, it will bend without torsion. However, if the beam is asymmetrical with respect to the plane of loading, the beam will be subjected to torsion as well as bending unless the loads pass through the shear center or flexural center of the particular section. It will be clear that the section of the rim outboard of the lines 23 on either side is essentially a channel section and the section outboard of line 30 is substantially so. The component of force exerted on the beam by the blade tending to bend or roll it is indicated by the arrow 34 in FIG. 3. The line of action of this force component 34 is outward of the shear center of the section which is indicated in FIG. 3 by the symbols at 35. The force acting on the rim as a beam will therefore tend to deflect the rim inward toward the blade. If, on the other hand, the force at 34 is inboard of the shear center, it will have the effect of deflecting the rim outwardly. This may be explained more fully by reference to FIG. 4, which is adopted from the Roark publication cited above. FIG. 4 illustrates a channel having an axis OY extending along the mid-section of the web of the channel, having flanges of thickness $t$ and of length $b$ from the axis OY to the end of the flanges, and having an axis OX which is an axis of symmetry midway between the identical flanges. The distance between the centers of the flanges is indicated as $h$. The location of the shear center of this section is indicated at the point Q which is on the axis OX at a distance $e$ from the axis OY outwardly from the channel. In the Figure, a load applied in the vertical direction parallel to axis OY at point Q will deflect the beam the cross-section of which is illustrated in FIG. 4 without twisting it.

A force exerted upwardly as illustrated to the right of point Q will twist the section counterclockwise as illustrated. On the other hand, force exerted upwardly and to the left of point Q will twist the beam clockwise. The location of point Q for any section can be determined along the line of the principles set out in the Timoshenko and Goodier citation above. Specifically, as stated by Roark for the section of FIG. 4, the distance $e$ is equal to the product of $h$ multiplied by $H_{xy}$ divided by $I_x$, in which $H_{xy}$ is the product of inertia of the half section (above $OX$) with respect to axes $OX$ and $OY$, and $I_x$ is the moment of inertia of the whole section with respect to the axis OX.

It will be seen that each side of the rim as illustrated in FIG. 3 corresponds rather closely to the simple channel delineated in FIG. 4, and that the shear center will reside outside the channel; that is, in the direction toward the central plane 20 at a distance which can be computed for any particular section. By altering the length and thickness of the flanges 27 and 28 and the dimensions of the portion of the rim side inboard of these flanges, the location of the shear center may be varied within reasonable limits. As pointed out above, if the shear center lies on the line of action 34 of the radial force exerted by the blade on the rim, this force will not tend to roll the rim either inwardly or outwardly. If the line of action 34 is outboard of the shear center 35 as illustrated in FIG. 3, the effect of the blade pull will be to turn the side of the rim inwardly toward the blade, thus increasing the security of attachment of the blade.

Figure 5:
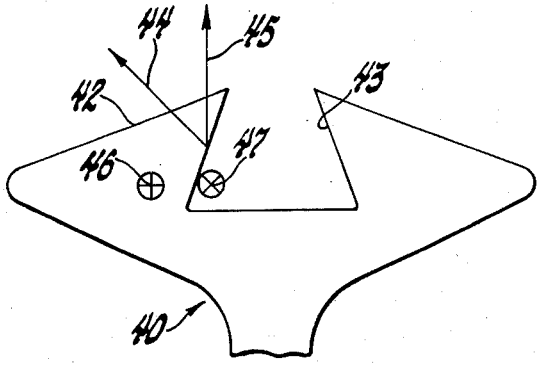
FIG. 5 illustrates modifications of the rim.

The principles of the invention are applicable to other sections than the channel illustrated and to other forms of blade attachments than that illustrated. FIG. 5 illustrates a rotor in which the wheel 40 has a rim 42 a side of which is generally of triangular section with the apex directed away from the central plane of the wheel. It also illustrates a structure in which the blade containing slot 43 is of a simple or single dovetail configuration to receive a blade having a flaring dovetail root. The forces tending to open or close or resist opening or closing of the slot 43 are of the same nature as those described above. Computation of actual values of these forces or deflections is, of course, a matter of the characteristics of the particular section which may vary considerably. However, the force exerted by the blades on the wheel due to centrifugal force, as indicated by the arrow 44, may be considered to pass through a point approximately at the middle of the depth of the wall of slot 43 and to have a radial component 45 passing through this point. Here the centroid of the flange is indicated at 46 and the shear center at 47 inboard of the centroid. In this case, as illustrated, the shear center is approximately on the line of action of the radial component of force due to the blade. The force exerted by the blade will also have an axial component which tends to spread the flange. Of course, this is the case regardless of the other considerations, but the effect of the load radial component to roll the section of the rim will be zero if the shear center 47 coincides with the line of action of this radial component.

I realize that wheels for a turbomachine having flanged rims have been proposed hitherto, for example, in Snow et al U.S. Pat. No. 3,059,901 issued Oct. 23, 1962. However, I am not aware of any prior appreciation or teaching of the principle set out above of configuring the rim to locate the shear center at a desired point with respect to the line of action of the force exerted radially outward on the rim by the blades.

It will be apparent that various configurations of the rim such as the channel of FIG. 3 or the triangular cross section of FIG. 5 may be employed with various configurations of blade retaining slots such as those of FIG. 3 or FIG. 5.

The detailed description of the preferred embodiment of the invention for the purpose of explaining the principles thereof is not to be considered as limiting or restricting the invention, since many modifications may be made by the exercise of skill in the art.

I claim:

1. A turbomachine rotor stage comprising a wheel including a disk and a rim at the periphery of the disk, the rim being substantially bilaterally symmetrical with respect to the central plane of the disk and having an axially central undercut circumferential slot for retention of blade roots; and an annular row of blade elements having roots mounted in the said slot; wherein the improvement comprises a rim the cross-section of which at each side of the said slot in any plane containing the axis of rotation of the wheel is substantially symmetrical about a line through the centroid of the section and parallel to the said axis of rotation and is asymmetrical about a line through the centroid of the section and normal to the said axis of rotation, and is of such a cross-section that the flexural center of each side of the rim is axially inboard of the radial plane of action of centrifugal forces exerted by the blade roots on the said side due to rotation of the rotor stage about the said axis.

2. A turbomachine rotor stage comprising a wheel including a disk and a rim at the periphery of the disk, the rim being substantially bilaterally symmetrical with respect to the central plane of the disk and having an axially central undercut circumferential slot for retention of blade roots; and an annular row of blade elements having roots mounted in the said slot; wherein the improvement comprises a rim the cross-section of which at each side of the said slot in any plane containing the axis of rotation of the wheel is substantially symmetrical about a line through the centroid of the section and parallel to the said axis of rotation and is asymmetrical about a line through the centroid of the section and normal to the said axis of rotation, and is of a generally channel shape with the base of the channel defining one wall of the said slot, so that the shear center of each side of the rim is axially inboard of the radial plane of action of centrifugal forces exerted by the blade roots on the said side due to rotation of the rotor stage about the said axis.

* * * * *